US011577244B2

(12) United States Patent
Parry-Jones et al.

(10) Patent No.: US 11,577,244 B2
(45) Date of Patent: Feb. 14, 2023

(54) MICROFLUIDIC DEVICE AND A METHOD OF LOADING FLUID THEREIN

(71) Applicant: Sharp Life Science (EU) Limited, Oxford (GB)

(72) Inventors: Lesley Anne Parry-Jones, Oxford (GB); Emma Jayne Walton, Oxford (GB)

(73) Assignee: Sharp Life Science (EU) Limited, Uxbridge (GB)

( * ) Notice: Subject to any disclaimer, the term of this patent is extended or adjusted under 35 U.S.C. 154(b) by 603 days.

(21) Appl. No.: 16/560,215

(22) Filed: Sep. 4, 2019

(65) Prior Publication Data

US 2020/0108396 A1 Apr. 9, 2020

(30) Foreign Application Priority Data

Sep. 12, 2018 (EP) ..... 18194098

(51) Int. Cl.
*B01L 3/00* (2006.01)

(52) U.S. Cl.
CPC ... *B01L 3/502792* (2013.01); *B01L 3/502715* (2013.01); *B01L 2200/0673* (2013.01);
(Continued)

(58) Field of Classification Search
None
See application file for complete search history.

(56) References Cited

U.S. PATENT DOCUMENTS 5,096,669 A 3/1992 Lauks et al.
6,565,727 B1 5/2003 Shenderov
(Continued)

FOREIGN PATENT DOCUMENTS

EP 2404675 1/2012
EP 2606975 6/2013
(Continued)

OTHER PUBLICATIONS

Fair, R.B., "Digital microfluids: is a true lab-on-a-chip possible?" Microfluidics and Nanofluidics Jun. 2007, vol. 3, Issue 3, pp. 245-281.

*Primary Examiner* — Matthew D Krcha
(74) *Attorney, Agent, or Firm* — Renner, Otto, Boisselle & Sklar, LLP

(57) ABSTRACT

A microfluidic device comprises upper and lower spaced apart substrates defining a fluid chamber therebetween; an aperture for introducing fluid into the fluid chamber; and a fluid input structure disposed over the upper substrate and having a fluid well for receiving fluid from a fluid applicator inserted into the fluid well. The fluid well communicates with a fluid exit provided in a base of the fluid input structure, the fluid exit being adjacent the aperture. The fluid well comprises first, second and third portions, with the first portion of the well forming a reservoir for a filler fluid; and the second portion of the well being configured to sealingly engage against an outer surface of a fluid applicator inserted into the fluid well. The third portion of the well communicates with the fluid exit and has a diameter at the interface between the third portion and the second portion that is greater than the diameter of the second portion at the interface between the third portion and the second portion.

20 Claims, 7 Drawing Sheets

(52) U.S. Cl.
CPC . *B01L 2300/047* (2013.01); *B01L 2300/0645* (2013.01); *B01L 2300/0809* (2013.01); *B01L 2400/0427* (2013.01)

(56) References Cited

U.S. PATENT DOCUMENTS

| | | | | |
|---|---|---|---|---|
| 6,911,132 | B2 | 6/2005 | Pamula et al. | |
| 7,163,612 | B2 | 1/2007 | Sterling et al. | |
| 8,653,832 | B2 | 2/2014 | Hadwen et al. | |
| 2004/0228770 | A1 | 11/2004 | Gandhi et al. | |
| 2004/0265172 | A1* | 12/2004 | Pugia | B01L 3/502746 436/180 |
| 2010/0270156 | A1* | 10/2010 | Srinivasan | B01F 33/3021 204/450 |
| 2010/0282608 | A1 | 11/2010 | Srinivasan et al. | |
| 2010/0282609 | A1 | 11/2010 | Pollack et al. | |
| 2013/0161193 | A1 | 6/2013 | Jacobs et al. | |
| 2013/0280725 | A1 | 10/2013 | Ismagilov et al. | |
| 2017/0056887 | A1 | 3/2017 | Hadwen et al. | |
| 2017/0059523 | A1 | 3/2017 | Hadwen et al. | |
| 2018/0104687 | A1* | 4/2018 | Walton | B01L 3/52 |

FOREIGN PATENT DOCUMENTS

| | | |
|---|---|---|
| EP | 3311918 | 4/2018 |
| EP | 3311919 | 4/2018 |
| EP | 3357575 | 8/2018 |
| EP | 3427831 | 1/2019 |
| GB | 2542372 | 3/2017 |
| WO | WO 0230560 | 4/2002 |
| WO | WO 03045556 | 6/2003 |
| WO | WO 2009052095 | 4/2009 |
| WO | WO 2009086403 | 7/2009 |
| WO | WO 2014062551 | 4/2014 |
| WO | WO 2017/047082 | 3/2017 |

* cited by examiner

MICROFLUIDIC DEVICE AND A METHOD OF LOADING FLUID THEREIN

TECHNICAL FIELD

The present invention relates to a microfluidic device, and to a method for loading fluid into such a device. More particularly, the invention relates to an Active Matrix Electro-wetting on Dielectric (AM-EWOD) microfluidic device. Electro-wetting-On-Dielectric (EWOD) is a known technique for manipulating droplets of fluid on an array. Active Matrix EWOD (AM-EWOD) refers to implementation of EWOD in an active matrix array incorporating transistors, for example by using thin film transistors (TFTs).

BACKGROUND ART

Microfluidics is a rapidly expanding field concerned with the manipulation and precise control of fluids on a small scale, often dealing with sub-microlitre volumes. There is growing interest in its application to chemical or biochemical assay and synthesis, both in research and production, and applied to healthcare diagnostics ("lab-on-a-chip"). In the latter case, the small nature of such devices allows rapid testing at point of need using much smaller clinical sample volumes than for traditional lab-based testing.

A microfluidic device can be identified by the fact that it has one or more channels (or more generally gaps) with at least one dimension less than 1 millimeter (mm). Common fluids used in microfluidic devices include whole blood samples, bacterial cell suspensions, protein or antibody solutions and various buffers. Microfluidic devices can be used to obtain a variety of interesting measurements including molecular diffusion coefficients, fluid viscosity, pH, chemical binding coefficients and enzyme reaction kinetics. Other applications for microfluidic devices include capillary electrophoresis, isoelectric focusing, immunoassays, enzymatic assays, flow cytometry, sample injection of proteins for analysis via mass spectrometry, PCR amplification, DNA analysis, cell manipulation, cell separation, cell patterning and chemical gradient formation. Many of these applications have utility for clinical diagnostics.

Many techniques are known for the manipulation of fluids on the sub-millimetre scale, characterised principally by laminar flow and dominance of surface forces over bulk forces. Most fall into the category of continuous flow systems, often employing cumbersome external pipework and pumps. Systems employing discrete droplets instead have the advantage of greater flexibility of function.

Electro-wetting on dielectric (EWOD) is a well-known technique for manipulating discrete droplets of fluid by application of an electric field. It is thus a candidate technology for microfluidics for lab-on-a-chip technology. An introduction to the basic principles of the technology can be found in "Digital microfluidics: is a true lab-on-a-chip possible?" (R. B. Fair, Microfluid Nanofluid (2007) 3:245-281).

FIG. 1 shows a part of a conventional EWOD device in cross section. The device includes a lower substrate 10, the uppermost layer of which is formed from a conductive material which is patterned so that a plurality of array element electrodes 12 (e.g., 12A and 12B in FIG. 1) are realized. The electrode of a given array element may be termed the element electrode 12. A liquid droplet 14, including a polar material (which is commonly also aqueous and/or ionic), is constrained in a plane between the lower substrate 10 and a top substrate 16. A suitable gap or channel between the two substrates may be realized by means of a spacer 18, and a nonpolar filler fluid or surround fluid 20 (e.g. an oil such as a silicone oil) may be used to occupy the volume not occupied by the liquid droplet 14. The function of the filler fluid is to reduce the surface tension at the surfaces of the polar droplets, and to increase the electro-wetting force, which ultimately leads to the ability to create small droplets and to move them quickly. It is usually beneficial, therefore, for the filler fluid to be present within the channel of the device before any polar fluids are introduced therein. Since the liquid droplet is polar and the filler fluid is non-polar the liquid droplet and the filler fluid are substantially immiscible.

An insulator layer 22 disposed upon the lower substrate 10 separates the conductive element electrodes 12A, 12B from a first hydrophobic coating 24 upon which the liquid droplet 14 sits with a contact angle 26 represented by θ. The hydrophobic coating is formed from a hydrophobic material (commonly, but not necessarily, a fluoropolymer). On the top substrate 16 is a second hydrophobic coating 28 with which the liquid droplet 14 may come into contact. Interposed between the top substrate 16 and the second hydrophobic coating 28 is a reference electrode 30.

The contact angle θ is defined as shown in FIG. 1, and is determined by the balancing of the surface tension components between the solid-to liquid ($\gamma_{SL}$), the liquid-to non-polar surrounding fluid ($\gamma_{LG}$) and the solid to non-polar surrounding fluid ($\gamma_{SG}$) interfaces, and in the case where no voltages are applied satisfies Young's law, the equation being given by:

$$\cos\theta = \frac{\gamma_{SG} - \gamma_{SL}}{\gamma_{LG}} \quad \text{(equation 1)}$$

In operation, voltages termed the EW drive voltages, (e.g. $V_T$, $V_0$ and $V_{00}$ in FIG. 1) may be externally applied to different electrodes (e.g. reference electrode 30, element electrodes 12, 12A and 12B, respectively). The resulting electrical forces that are set up effectively control the hydrophobicity of the hydrophobic coating 24. By arranging for different EW drive voltages (e.g. $V_0$ and $V_{00}$) to be applied to different element electrodes (e.g. 12A and 12B), the liquid droplet 14 may be moved in the lateral plane between the two substrates 10 and 16.

FIG. 2 is a drawing depicting additional details of an exemplary AM-EWOD device 36 in schematic perspective, which may incorporate the layered structures in FIG. 1. The AM-EWOD device 36 has a lower substrate 44 with thin film electronics 46 disposed upon the lower substrate 44, and a reference electrode (not shown, but comparable to reference electrode 30 above) is incorporated into an upper substrate 54. The electrode configuration may be reversed, with the thin film electronics being incorporated into the upper substrate and the reference electrode being incorporated into the lower substrate. The thin film electronics 46 are arranged to drive array element electrodes 48—for example the thin film electronic 46 associated with an array element electrode may comprise one or more thin-film transistors (TFTs) that are controlled by an EWOD control unit (not shown). A plurality of array element electrodes 48 are arranged in an electrode or element array 50, having X by Y array elements where X and Y may be any integer. A liquid droplet 52 which may include any polar liquid and which typically may be aqueous, is enclosed between the lower substrate 44 and the upper substrate 54 separated by a spacer 56, although it will be appreciated that multiple liquid droplets 52 can be present.

As described above with respect to the representative EWOD structure, the EWOD channel or gap defined by the two substrates initially is filled with the nonpolar filler fluid (eg oil). The liquid droplets 14/52 including a polar material, i.e., the droplets to be manipulated by operation of the EWOD device, must be inputted from an external "reservoir" of fluid into the EWOD channel or gap. The external reservoir may for example be a pipette, or may be a structure incorporated into the plastic housing of the device. As the fluid from the reservoir for the droplets is inputted, filler fluid gets displaced and is removed from the EWOD channel.

Example configurations and operation of EWOD devices are described in the following. U.S. Pat. No. 6,911,132 (Pamula et al., issued Jun. 28, 2005) discloses a two dimensional EWOD array to control the position and movement of droplets in two dimensions. U.S. Pat. No. 6,565,727 (Shenderov, issued May 20, 2003) further discloses methods for other droplet operations including the splitting and merging of droplets, and the mixing together of droplets of different materials. U.S. Pat. No. 7,163,612 (Sterling et al., issued Jan. 16, 2007) describes how TFT based thin film electronics may be used to control the addressing of voltage pulses to an EWOD array by using circuit arrangements very similar to those employed in AM display technologies.

The review "Digital microfluidics: is a true lab-on-a-chip possible?", R.B. Fair, Microfluid Nanofluid (2007) 3:245-281) notes that methods for introducing fluids into the EWOD device are not discussed at length in the literature. It should be noted that this technology employs the use of hydrophobic internal surfaces. In general, therefore, it is energetically unfavourable for aqueous fluids to fill into such a device from outside by capillary action alone. Further, this may still be true when a voltage is applied and the device is in an actuated state. Capillary filling of non-polar fluids (e.g. oil) may be energetically favourable due to the lower surface tension at the liquid-solid interface.

A few examples exist of small microfluidic devices where fluid input mechanisms are described. U.S. Pat. No. 5,096,669 (Lauks et al.; published Mar. 17, 1992) shows such a device comprising an entrance hole and inlet channel for sample input coupled with an air bladder which pumps fluid around the device when actuated. It is does not describe how to input discrete droplets of fluid into the system nor does it describe a method of measuring or controlling the inputted volume of such droplets. Such control of input volume (known as "metering") is important in avoiding overloading the device with excess fluid and helps in the accuracy of assays carried out where known volumes or volume ratios are required.

US20100282608 (Srinivasan et al.; published Nov. 11, 2010) describes an EWOD device comprising an upper section of two portions with an aperture through which fluids may enter. It does not describe how fluids may be forced into the device nor does it describe a method of measuring or controlling the inputted volume of such fluids. Related application US20100282609 (Pollack et al.; published Nov. 11, 2010) does describe a piston mechanism for inputting the fluid, but again does not describe a method of measuring or controlling the inputted volume of such fluid.

US20100282609 describes the use of a piston to force fluid onto reservoirs contained in a device already loaded with oil. US20130161193 describes a method to drive fluid onto a device filled with oil by using, for example, a bistable actuator.

GB2542372 and WO 2017/047082 describe a microfluidic AM-EWOD device configured to, when the chamber of the device contains a metered volume of a filler fluid that partially fills the chamber, preferentially maintain the metered volume of the filler fluid in a part of the chamber. FIG. 3 is a schematic plan view of a microfluidic AM-EWOD device of GB 2542372/WO 2017/047082, after a metered volume of filler fluid has been introduced into the fluid chamber. The metered volume of filler fluid does not completely fill the fluid chamber, and the part of the fluid chamber containing filler fluid is shown shaded in FIG. 3. Filler fluid is preferentially maintained in a first region 5 of the fluid chamber by means of a fluid barrier 6, and there exists a second region 7 of the fluid chamber that is not filled with filler fluid and that contains a venting fluid such as air. The device is configured to allow displacement of some of the filler fluid from the part of the chamber when a volume of a working fluid (or assay fluid) 8 is introduced into the part of the chamber containing filler fluid, eg via port 9, thereby causing a volume of the venting fluid to vent from the chamber via a vent 11.

SUMMARY

A first aspect of the present invention provides a microfluidic device comprising: upper and lower spaced apart substrates defining a fluid chamber therebetween; an aperture for introducing fluid into the fluid chamber; and a fluid input structure disposed over the upper substrate and having a fluid well for receiving fluid from a fluid applicator inserted into the fluid well, the fluid well communicating with a fluid exit provided in a base of the fluid input structure, the fluid exit being adjacent the aperture; wherein the fluid well comprises first, second and third portions, the first second and third portions different from one another, the first portion of the well forming a reservoir for a filler fluid; the second portion of the well being configured to sealingly engage against an outer surface of a fluid applicator when the fluid applicator is inserted into the fluid well; and the third portion of the well communicating with the fluid exit and having a diameter at the interface between the third portion and the second portion that is greater than the diameter of the second portion at the interface between the third portion and the second portion. The microfluidic device may be an electrowetting on dielectric (EWOD) microfluidic device, that further comprises a plurality of element electrodes, each element electrode defining a respective element of the EWOD device.

In this aspect, when a fluid applicator is inserted into the fluid well, the part of the fluid applicator from which working fluid is dispensed (this is typically an end of the applicator) touches the surface of, and passes into, the filler fluid in the well before the outer surface of the fluid applicator seals against the second portion of the well. This prevents air from being entrapped in the working fluid dispensed from the applicator and so prevents air from being introduced into the fluid chamber of the microfluidic device. (The term "below" relates to a device oriented as shown in, for example, FIG. 5(*a*) or 5(*b*).)

The second portion of the fluid well may be adjacent to the first portion of the fluid well. Alternatively, the second portion of the fluid well may be spaced to the first portion of the fluid well—for example, if the first portion has a different cross section to the second portion, the first portion may be spaced from the second portion by a "transition" portion in which the cross-section gradually changes from the cross section of the first portion to the cross section of the second portion, to avoid an abrupt change in the cross section of the fluid well.

The aperture may be defined between the upper substrate and the lower substrate.

The aperture may be defined in the upper substrate.

The axial length of the third region of the well may be such that, when the fluid applicator is inserted into the fluid input structure so that the outer surface the fluid applicator sealingly engages against the second portion of the well, an end of the fluid applicator is spaced from the upper and lower substrates.

The fluid input structure may extend around a periphery of the upper substrate.

The device may comprise a plurality of apertures for introducing fluid into the fluid chamber; wherein the fluid input structure comprises a plurality of fluid wells, each fluid well associated with a respective aperture.

The fluid well may be configured to engage with a fluid applicator inserted into the fluid well, to thereby prevent further movement of the fluid applicator into the fluid well.

A second aspect of the invention provides a method of loading a fluid into a microfluidic device of the first aspect, the method comprising: loading a filler fluid into the microfluidic device such that the filler fluid at least partially fills the first portion of the fluid well; inserting a fluid applicator into the fluid well such that the outer surface of the fluid applicator sealingly engages against the second portion of the fluid well; and dispensing working fluid from the fluid applicator.

In a method of this aspect, the part of the fluid applicator from which working fluid is dispensed (this is typically an end of the applicator) is below the surface of the filler fluid in the fluid well when the outer surface of the fluid applicator seals against the second portion of the well (and when the working fluid is subsequently dispensed from the applicator). This prevents air from being entrapped in the dispensed working fluid and so prevents air from being introduced into the fluid chamber of the microfluidic device.

The method may further comprise dispensing a predetermined volume of working fluid from the fluid applicator.

The method may further comprise, after dispensing the working fluid from the fluid applicator into the fluid well, dispensing a second fluid from the fluid applicator.

The dispensed second fluid may remain connected to the fluid applicator.

The second fluid may be a fluid that is different to both the filler fluid and the working fluid. The second fluid may be air.

The method may further comprise actuating at least one element electrode of the microfluidic device to hold the dispensed working fluid in the fluid chamber of the microfluidic device.

The method may further comprise, after actuating the at least one element electrode, extracting the second fluid from the fluid chamber. This may be done by removing the fluid applicator from the well such that any second fluid dispensed from the fluid applicator that entered the microfluidic device is extracted upon removal of the applicator. As an example, if the applicator is a pipette, working fluid is dispensed by pushing the pipette plunger to a first position (such as the "stop" described below) and second fluid has been dispensed by pushing the pipette plunger past the "stop" in the manner described below, retracting the pipette from the well with the plunger held in the 'down' position, in which the pipette plunger is pushed in to its maximum extent or at least is still pushed in beyond the stop, will result in retraction of second fluid from the chamber. If desired, this technique may be applied in combination with one of the techniques described below for moving dispensed working fluid to a "safe" region in the fluid chamber and/or holding moving dispensed working fluid at a "safe" region in the fluid chamber to eliminate (or substantially reduce) the risk of working fluid inadvertently being extracted with the second fluid Alternatively, extracting the second fluid from the fluid chamber may be done before the fluid applicator is retracted. As an example, if the applicator is a pipette, working fluid has been dispensed by pushing the pipette plunger to a first position (such as the "stop" described below) and second fluid has been dispensed by pushing the pipette plunger past the "stop" in the manner described below, leaving the pipette in position and returning the plunger to the stop position (or allowing the plunger to return to the stop position), will result in retraction of second fluid from the chamber. After the plunger has returned/been returned to the "stop" position and the second fluid retracted, the pipette may then be retracted. If desired, this technique may be applied in combination with one of the techniques described below for moving dispensed working fluid to a "safe" region in the fluid chamber and/or holding moving dispensed working fluid at a "safe" region in the fluid chamber, to eliminate (or substantially reduce) the risk of working fluid inadvertently being extracted with the second fluid.

The method may further comprise after actuating the at least one element electrode, extracting a volume of filler fluid from the fluid chamber. In the example where the applicator is a pipette, and second fluid has been dispensed by pushing the pipette plunger past a "stop", allowing the pipette plunger to return to its 'fully out' position before retracting the pipette from the well will result in retraction from the chamber of both second fluid and a volume of filler fluid.

The volume of filler fluid extracted from the fluid chamber may be equal to the volume of working fluid dispensed from the fluid applicator.

The fluid applicator may be a pipette and dispensing fluid from the fluid applicator may comprise pushing a plunger of the pipette to a first position to dispense working fluid and subsequently pushing the plunger beyond the first position to dispense the second fluid, and extracting the second fluid from the fluid chamber may comprise retracting the fluid applicator from the well with the plunger beyond the first position.

The fluid applicator may be a pipette and dispensing fluid from the fluid applicator may comprise pushing a plunger of the pipette to a first position to dispense working fluid and subsequently pushing the plunger beyond the first position to dispense the second fluid, and extracting the second fluid from the fluid chamber may comprise returning the plunger, or allowing the plunger to return, to the first position before retracting the fluid applicator from the well.

The method may further comprise monitoring the area of the region of the fluid chamber in which working fluid is present as the second fluid and/or filler fluid are extracted. If the region in which working fluid is present should decrease in size this would indicate that working fluid has inadvertently been extracted, and an output can be provided to indicate this. In the case of manual fluid loading the output is provided to a user and may for example be an audible and/or visual output, whereas in the case of automated or robotic fluid loading the output is provided to a control unit that is controlling the automated or robotic fluid loading and may for example be an electrical or optical signal.

A third aspect of the invention provides a method of loading a fluid into a microfluidic device, the microfluidic device comprising: upper and lower spaced apart substrates defining a fluid chamber therebetween; an aperture for receiving fluid into the fluid chamber; and a fluid input structure disposed over the upper substrate and having a fluid well for receiving fluid from a fluid applicator inserted into the fluid input structure, the fluid well communicating with a fluid exit provided in a base of the fluid input structure, the fluid exit being adjacent the aperture, the method comprising: loading a filler fluid into the microfluidic device such that the filler fluid at least partially fills the fluid well; inserting a fluid applicator into the fluid well such that the outer surface of an end of the fluid applicator sealingly engages against the fluid well at a position below the surface of the filler fluid; and dispensing working fluid from the fluid applicator into the fluid well.

The method may further comprise dispensing a predetermined volume of working fluid from the fluid applicator.

A fourth aspect of the present invention provides an active matrix electrowetting on dielectric (AM-EWOD) microfluidic device comprising: upper and lower spaced apart substrates defining a fluid chamber therebetween; an aperture for introducing fluid into the fluid chamber; a plurality of independently addressable array element electrodes, each array element electrode defining a respective array element, and each array element corresponding to a respective region of the fluid chamber; and control means for addressing the array elements, the control means configured to: determine, by controlling the EWOD array elements to operate in a sensing mode, that a working fluid has been introduced into a first region of the fluid chamber; and provide an output to indicate that the working fluid is present in the first region.

Once the working fluid is in the first region, the fluid applicator used to dispense the fluid can then be removed without any risk of accidentally withdrawing the dispensed working fluid from the microfluidic device. Thus in the case of manual loading of the working fluid the output may inform a user that it is safe to remove the applicator, or in the case of automatic or robotic loading of fluid the output signal may be provided to the system controlling the automatic or robotic loading of fluid so that the system can remove the fluid applicator.

A device of the fourth aspect may further comprise a fluid input structure disposed over the upper substrate and having a fluid well for receiving fluid from a fluid applicator inserted into the fluid well, the fluid well communicating with a fluid exit provided in a base of the fluid input structure, the fluid exit being adjacent the aperture; wherein the fluid well comprises first, second and third portions, the first portion of the well forming a reservoir for a filler fluid; the second portion of the wellbeing configured to sealingly engage against an outer surface of a fluid applicator inserted into the fluid well; and the third portion of the well communicating with the fluid exit and having a diameter at the interface between the third portion and the second portion that is greater than the diameter of the second portion at the interface between the third portion and the second portion.

A device of the first aspect may further comprises a plurality of independently addressable array elements, each array element defining a respective region of the fluid chamber; and control means for addressing the array elements, the control means configured to: determine that a working fluid has been introduced into a first region of the fluid chamber; and provide an output to a user to indicate that the working fluid is present in the first region.

In a device of the first or fourth aspect the control means may be configured to actuate a first group of the array elements of the microfluidic device, the first group of the array elements corresponding to the first region of the fluid chamber to move working fluid introduced via the aperture to the first region of the fluid chamber.

In a device of the first or fourth aspect the control means may be configured to: before actuating the first group of the array elements, actuate a second group of the array elements of the microfluidic device, the second group of the array elements defining a second region of the fluid chamber different from the first region, the second region extending to the aperture.

In a device of the first or fourth aspect the control means may be configured to actuate the second group of the array elements upon detecting working fluid in the second region of the fluid chamber.

In a device of the first or fourth aspect the control means may be configured to actuate the second group of the array elements such that the second region of the fluid chamber matches the region of the fluid chamber occupied by the working fluid.

In a device of the first or fourth aspect the control means may be configured to actuate the second group of the array elements in a time-dependent manner.

In a device of the first or fourth aspect the control means may be configured to actuate the first group of the array elements upon determining that the region of the fluid chamber occupied by the working fluid has reached a predetermined size.

In a device of the first or fourth aspect the control means may be configured to actuate the first group of array elements upon determining that the rate of change of size of the region of the fluid chamber occupied by the working fluid is below a predetermined threshold.

A variant of the fourth aspect provides a microfluidic device comprising upper and lower spaced-apart substrates defining a fluid chamber therebetween; an aperture for introducing fluid into the fluid chamber; and a plurality of independently addressable array elements, each array element defining a respective region of the fluid chamber. The device is configured to: determine that a working fluid has been introduced into a first region of the fluid chamber; and provide an output to a user to indicate that the working fluid is present in the first region. Any feature described herein as suitable for use with a device of the fourth aspect may be provided in a device according to this variant of the fourth aspect.

A fifth aspect of the invention provides a method of loading a fluid into a microfluidic device, the microfluidic device comprising: upper and lower spaced apart substrates defining a fluid chamber therebetween; and an aperture for receiving fluid into the fluid chamber; the method comprising: loading a filler fluid into the microfluidic device; disposing the end of a fluid applicator at or near the aperture; dispensing working fluid from the fluid applicator into a loading region adjacent the aperture and external to the fluid chamber; and forcing the working fluid from the loading region into the fluid chamber via the aperture.

The method of this aspect may be used with a device where, when working fluid is initially dispensed from the fluid applicator, the fluid may not load fully into the desired region of the microfluidic device.

Forcing, or urging, the working fluid from the loading region into the fluid chamber may comprise dispensing a second fluid from the pipette to thereby force the working fluid from the loading region into the fluid chamber via the aperture. In this embodiment the fluid applicator is further actuated to dispense a bubble of air (or other fluid different to the working fluid being dispensed), so as to load the working fluid fully into the desired region of the microfluidic device.

The second fluid may be a fluid different to the working fluid. The second fluid may for example be air, or may be filler fluid.

The method may further comprise actuating at least one array element of the microfluidic device to hold the dispensed working fluid in the fluid chamber of the microfluidic device.

Forcing the working fluid from the loading region into the fluid chamber may alternatively or additionally comprise actuating at least one array element of the microfluidic device to draw the dispensed working fluid in the fluid chamber of the microfluidic device.

The method may further comprise determining that a working fluid has been introduced into a region of the fluid chamber; and providing an output to indicate that the working fluid is present in the region. For example, the region may be a target region of the fluid chamber, into which it is desired to load the working fluid, in which case the output indicates that the working fluid has been successfully loaded into the target region of the fluid chamber. Alternatively, the region may be a region of the fluid chamber into which it is not desired to load the working fluid, in which case the output indicates that an error has occurred in the loading of the working fluid. In the case of manual fluid loading the output is provided to a user and may for example be an audible and/or visual output, whereas in the case of automated or robotic fluid loading the output is provided to a control unit that is controlling the automated or robotic fluid loading and may for example be an electrical or optical signal.

Alternatively or additionally, the method may further comprise determining that working fluid has been introduced into a region of the fluid chamber, comparing the region with a desired region, and providing an output based on the result of the comparison. For example, this method may provide an output (an alert) if the region into which working fluid has been introduced is different to the region into which it is desired to introduce the working fluid. For example if the region occupied by the working fluid is smaller than the region into which it is desired to introduce the working fluid this would suggest that an insufficient amount of the working fluid has been introduced, whereas if the region occupied by the working fluid is smaller than the region into which it is desired to introduce the working fluid this would suggest that an excess amount of the working fluid has been introduced. Alternatively, if the region occupied by the working fluid has the same area as, but is displaced from (either partially overlapping or separate from) the region into which it is desired to introduce the working fluid this suggests that the fluid has been introduced into an incorrect region of the device.

Alternatively or additionally, the method may further comprise monitoring the region of the fluid chamber in which working fluid is present as the fluid applicator is withdrawn. If the region in which working fluid is present should decrease in size this would indicate that working fluid has inadvertently been retracted, and an output can be provided to alert the user/control unit. If however the region in which working fluid is present does not decrease in size as the fluid applicator is withdrawn this would indicate that the fluid applicator has successfully been withdrawn without causing retraction of working fluid from the fluid chamber, and an output confirming this may alternatively or additionally be provided.

The method may further comprise actuating a target group of array elements corresponding to a target region of the fluid chamber to move working fluid introduced via the aperture to the target region of the fluid chamber. Again, the "target" region is a region of the fluid chamber into which it is desired to load the working fluid.

The method may further comprise: before actuating the target group of array elements, actuating a second group of the array elements defining a second region of the fluid chamber different from the target region, the second region being nearer to the aperture than the target region. In this embodiment the second group of array elements are actuated to assist with initial loading of the working fluid into the microfluidic device and/or to assist with initial movement of the working fluid to the target region for the working fluid. Subsequently the second group of array elements are deactuated, and the target group of array elements are actuated to assist with completion of movement of the working fluid to the target region for the working fluid. The second region may extend to the aperture, or may be spaced from the aperture.

The method may further comprise actuating the second group of array elements upon (for example, in response to) or after detecting working fluid in the second region of the fluid chamber.

The method may further comprise actuating the second group of array elements such that the second region of the fluid chamber matches the region of the fluid chamber occupied by the working fluid.

The method may further comprise actuating the second group of array elements in a time-dependent manner.

The method may further comprise actuating the target group of array elements upon (or after) determining that the region of the fluid chamber occupied by the working fluid has reached a predetermined size.

The method may further comprise actuating the target group of array elements upon (or after) determining that the rate of change of size of the region of the fluid chamber occupied by the working fluid is below a predetermined threshold.

In a method of the fifth aspect, the device may further comprise a fluid input structure disposed over the upper substrate and having a fluid well for receiving fluid from a fluid applicator inserted into the fluid well, the fluid well communicating with a fluid exit provided in a base of the fluid input structure, the fluid exit being adjacent the aperture; wherein the fluid well comprises first, second and third portions, the first portion of the well forming a reservoir for a filler fluid; the second portion of the well being configured to sealingly engage against an outer surface of a fluid applicator inserted into the fluid well; and the third portion of the well communicating with the fluid exit and having a diameter at the interface between the third portion and the second portion that is greater than the diameter of the second portion at the interface between the third portion and the second portion; and the method may comprise, before dispensing working fluid from the fluid applicator, loading a filler fluid into the microfluidic device such that the filler fluid at least partially fills the first portion of the fluid well; and inserting the fluid applicator into the fluid well such that the outer surface of the fluid applicator sealingly engages against the second portion of the fluid well.

In any aspect or implementation the microfluidic device may be an EWOD (Electro-wetting on Dielectric) device.

BRIEF DESCRIPTION OF DRAWINGS

Preferred embodiments of the present invention will now be described by way of illustrative example with reference to the accompanying figures in which:

FIG. 5(*b*) corresponds to FIG. 5(*a*) but shows a pipette inserted.

DESCRIPTION OF EMBODIMENTS

Figure 1:
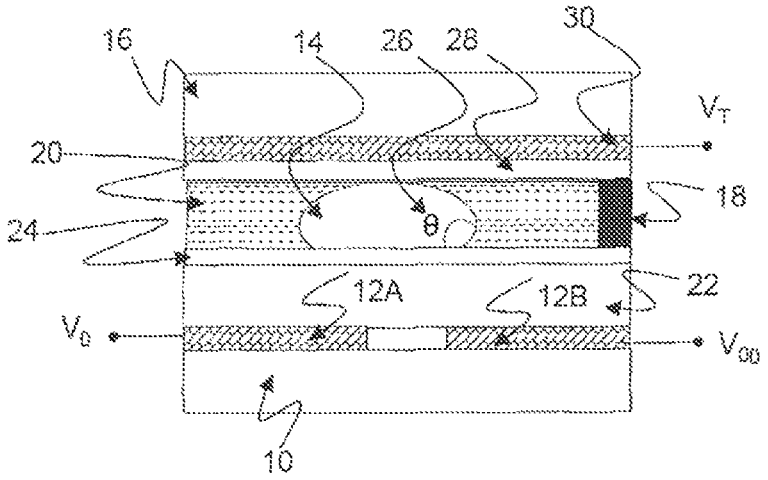
FIG. 1 is a drawing depicting a conventional EWOD device in cross-section.
Figure 2:
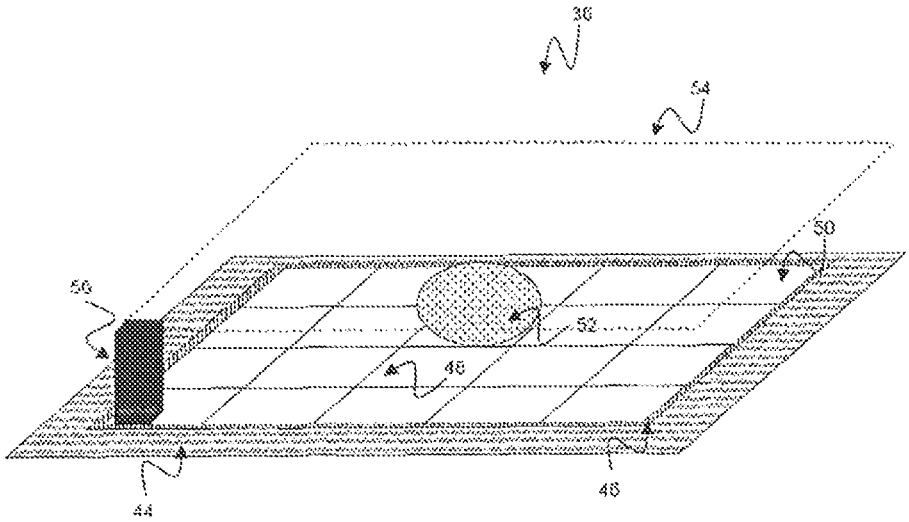
FIG. 2 is a drawing depicting an exemplary AM-EWOD device in schematic perspective.

Embodiments of the present invention will now be described with reference to the drawings, wherein like reference numerals are used to refer to like elements throughout. It will be understood that the figures are not necessarily to scale.

Figure 3:
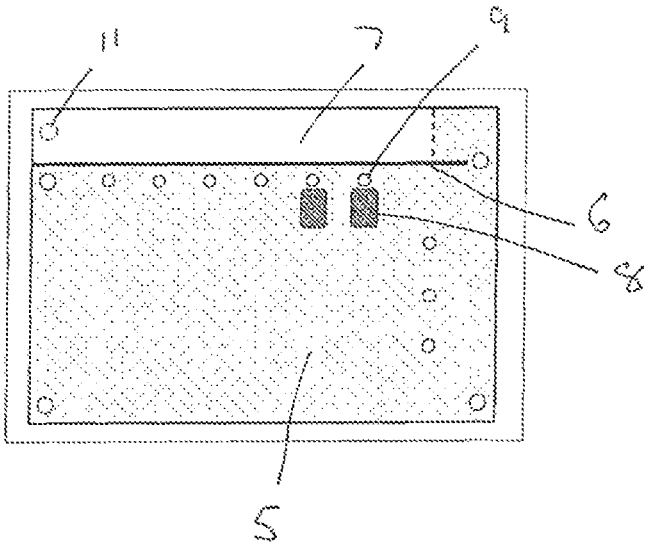
FIG. 3 is a schematic view from above of a microfluidic device as described in WO 2017/047082.

It has been realised that, while the microfluidic device of GB 2542372/WO 2017/047082 shown in FIG. 3 facilitates loading of a working fluid (also referred to as an "assay fluid" or as an "aqueous fluid") into the fluid chamber, there are two problems which may arise on any subsequent heating of the device (as will be required in some applications of such a device).

One problem which may arise in the device of FIG. 3 is that if the total volume of the fluids (filler fluid and working fluid(s)) loaded into the fluid chamber is less than the total volume of the fluid chamber of the device, a bubble of air (or other venting fluid) will remain within the device. So long as the device is held at a uniform temperature (e.g. at room temperature), and the cell-gap of the device is relatively uniform, then this bubble will remain in a controlled position in the region 7 of the fluid chamber, as determined by the design of the barrier 6 and location of the port used for loading the filler fluid. However, if the device is heated in such a way that thermal gradients exist within the device, that air bubble will tend to move towards the hottest part of the device and may move into the region 5 of the fluid chamber which corresponds to the active region of the device.

In principle this problem can be avoided by making sure that exactly the right volume of filler fluid is loaded into the device so that all venting fluid is expelled from the device when the working fluid(s) are loaded, or by topping up with filler fluid after the loading of working fluid(s) loading is finished. However, the first of these is very difficult to achieve in practice, as there will inevitably be small variations in device capacity and pipetting volumes. The second of these is acceptable for laboratory usage, but is not necessarily a desirable aspect for a commercial product intended for use in non-laboratory conditions.

A second problem which may arise in the device of FIG. 3 is that even if all of the required fluids are loaded into the device, with a single loading step of oil (or other filler fluid) and no remaining air bubble, then as the device is heated up, the oil (or other filler fluid) will evaporate into the atmosphere. This reduces the volume of fluids in the fluid chamber, and an air bubble re-appears.

One solution to this first problem is to completely fill the fluid chamber with filler fluid as a first stage of the fluid loading process, and then load working fluid(s) into the fluid chamber when the device is full of filler fluid. Ways of achieving this are described below. However, this does not solve the second problem, as an air bubble may re-appear upon with heating the device so that this approach is limited to cases where the device will not be heated non-uniformly.

Completely sealing the device to prevent evaporation of filler fluid has been found not to be a solution, because any air gaps between the seal and the filler fluid will expand if the device is heated and these expanded air bubble can then possibly encroach onto the active area of the device.

1. Loading of Working Fluid via a housing

Figure 4:
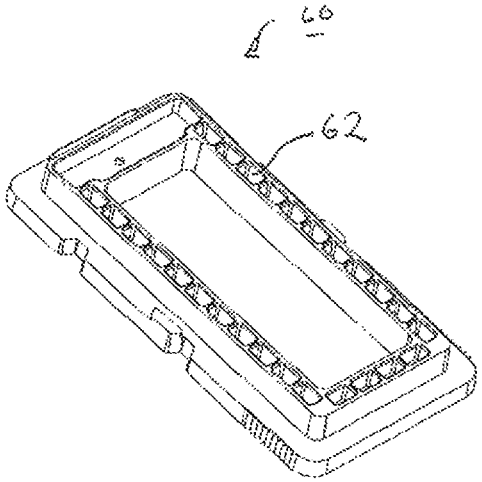
FIG. 4 is a schematic perspective view of a housing for a microfluidic device according to an embodiment of the invention.

FIG. 4 illustrates a housing 60 for a microfluidic device, for assisting loading of working fluid into the microfluidic device. The housing is intended for use with a microfluidic device of the type generally described above, such as an EWOD device, that uses a polar working fluid and a non-polar filler fluid; as such, the working fluid and the filler fluid can, for the purposes of the application, be regarded as immiscible.

Figure 5A:
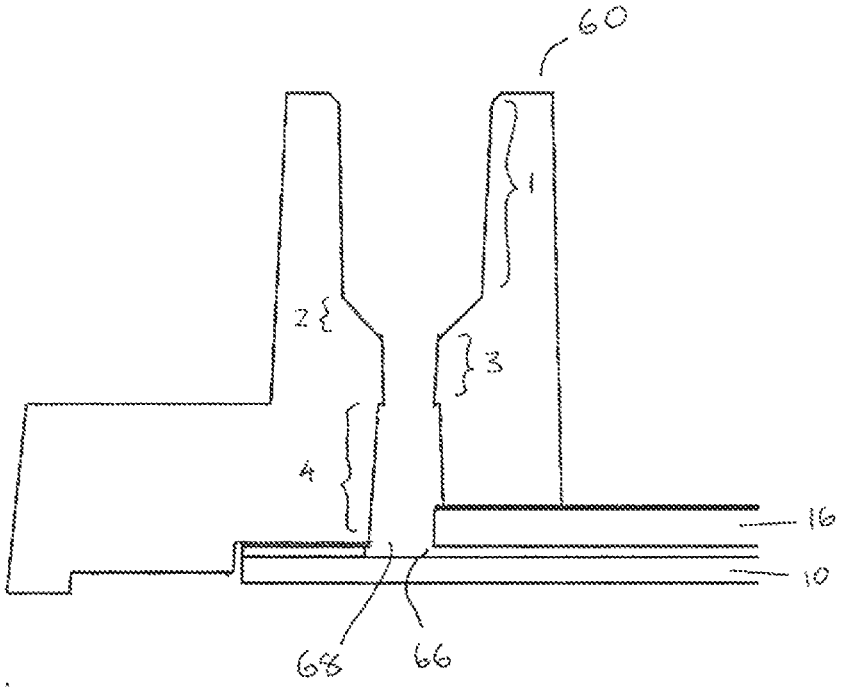
FIG. 5(*a*) is a partial sectional view through a microfluidic device having a housing as shown in FIG. 4.
Figure 5B:
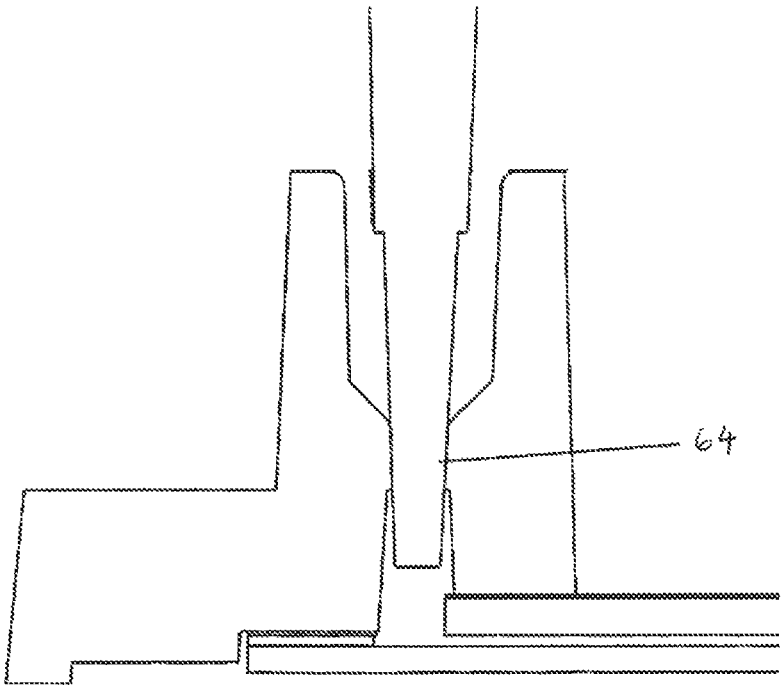

The housing contains at least one fluid well 62, and preferably contains multiple fluid wells. FIG. 5(*a*) is a cross-section through a microfluidic device having a housing 60, through a fluid well of the housing. The fluid wells also function as a port for receiving a fluid applicator for dispensing a working fluid for loading into the microfluidic device. The invention is described herein with reference to embodiments in which a pipette is used as the fluid applicator but any suitable fluid applicator may be used. The invention may be used with for example a fluid applicator that is controlled manually, with a fluid applicator that is controlled remotely by a user (eg is controlled electronically), with a fluid applicator that requires manual insertion into the fluid well but in which the dispensing of fluid is controlled automatically or with a robotic fluid applicator in which both insertion into/removal from the fluid well and the dispensing of fluid are controlled automatically. In the case of automatic control, this may be in accordance with a determined set of instructions. Examples of suitable fluid applicators include pipettes manufactured by Gilson, Inc., for example pipettes from their Pipetman™ range of pipettes. Other examples of suitable fluid applicators include, but are not limited to, a pipette and pipette tip in combination (pipette tips, which may be disposable, may be used with pipettes to speed processing and reduce cross-contamination, and are available in standardised sizes); a disposable dropper pipette, examples of which include the Pastette® range from Alpha Laboratories, Hampshire, UK; a syringe; a burette; a capillary; an automated fluid injector, examples of which include the Drummond Nanoject II™ from Drummond Scientific Company, Pennsylvania, USA.

Further, it may be advantageous to use a fluid applicator that can dispense a pre-determined amount of working fluid, and particularly advantageous to use a fluid applicator that can be loaded with the exact amount of fluid it is desired to dispense such that no working fluid remains in the applicator after the pre-determined amount of working fluid has been dispensed.

FIG. 5(*b*) corresponds to FIG. 5(*a*) but shows the dispensing end 64 of a pipette inserted into the fluid well 62 to a "docked position" suitable for fluid to be dispensed from the pipette. In the docked position of FIG. 5(*b*) an outer surface of the end 64 seals against region 3 of the fluid well. (It should be noted that in practice many commercially available pipettes are used in combination with a disposable pipette tip and in such a case the combination of the pipette and disposable pipette tip are inserted into the fluid well, and it is the outer surface of the end of the pipette tip that will seal against the region 3 of the fluid well. References to inserting a "pipette" into a fluid well should therefore be understood as also covering the insertion of the combination of a pipette and a (for example, disposable) pipette tip. Examples of suitable pipette tips for use with a pipette include, but are not limited to, pipette tips supplied by Gilson Inc., Mettler Toledo International Inc (under the Rainin brand), Starlab (UK), Ltd, Eppendorf AG, Alpha Laboratories Limited (the Sartorius range) and/or VWR International, LLC. Examples of suitable sizes of pipette tips include, but are not limited to, sizes: P2, P10, P20, P30, P100, or P200.)

The housing may be manufactured by any suitable process, for example, by plastic injection moulding or by 3-D printing. The microfluidic device may then be positioned in and attached to the housing, and the resultant product is sometimes known as a "cartridge". The housing and microfluidic device may be attached together in any suitable way, for example using an adhesive. In one manufacturing method described in co-pending European patent application No. 18182737.9, the contents of which are hereby incorporated by reference, a substrate of the microfluidic device is initially attached to the housing using double sided adhesive tape. Once it is checked that the housing is correctly positioned, further adhesive may then be introduced into the joint between the housing and the substrate of the microfluidic device, for example by capillary filling, to ensure a fluid-tight seal between the housing and the substrate.

FIG. 4 illustrates a housing 60 for use with a microfluidic device (for example an EWOD device or AM-EWOD device) in which the area of the upper substrate (substrate 16 in FIG. 1) is less than the area of the lower substrate (substrate 10 in FIG. 1) so that the upper substrate does not completely overlap the lower substrate thereby forming one or more apertures 66 for loading fluid into the fluid chamber of the microfluidic device. This aspect of the invention is not however limited to such a microfluidic device, and may also be applied with a microfluidic device in which the upper substrate 16 completely overlaps the lower substrate 10 and one or more apertures for loading fluid are provided in the upper substrate 16. The fluid well 62 communicates with a fluid exit 68 provided in a base of the housing, and the fluid exit is generally adjacent to the aperture 66 in the microfluidic device.

In FIG. 5(*a*) the fluid well/pipette port can be seen to consist of 4 main regions. The regions are arranged in sequence along the axis of the fluid well, with the first region 1 being furthest from the substrates 10, 16 of the microfluidic device, and the fourth region 4 being closest to the substrates 10, 16 of the microfluidic device (and typically making contact with at least the upper substrate 16).

The first region 1, or "reservoir region", is the widest region of the well, with an internal diameter that is greater than the external diameter of the pipette to be used with the well, and forms a reservoir for accommodating oil (or other filler fluid) so that when the microfluidic device and the housing are heated up, the inevitable evaporation that occurs does not lead to an air bubble forming within the channel of the EWOD device. The height and diameter of the first region 1 will be determined by factors such as how much filler fluid needs to be accommodated in the fluid well and the extent to which the level of filler fluid in the reservoir region will rise when a pipette is inserted into the fluid well and displaces some filler fluid.

The second region 2 acts as a transition between the first region 1 (wide) and the third region 3 (narrow).

The third region, or "sealing region", 3 is a small diameter region (the cross-sectional diameter of the well is lower in the third region than in the first region) which acts to form a seal with the end of the pipette when it is introduced into the fluid well (and pushed reasonably firmly downwards). The taper angle of the walls in the third region 3 preferably matches the taper of the end of the pipette in order to create a secure seal that exists over some height range and not just at one height (as would be the case if the angle were not the same as that of the outer surface of the pipette). (Alternatively, if the pipette, or other applicator, is made of a material that deforms upon insertion into the well a secure seal may be obtained even if the taper angle of the third region does not match the taper angle of the pipette/applicator; in this case the third region may have a zero taper angle and so have a substantially uniform cross-section over its length.)

As described below, in preferred methods of loading working fluid(s) into the fluid chamber the level of the filler fluid within the microfluidic device at the moment when working fluid(s) are being loaded is high enough that the filler fluid extends at least partially into the second region 2 and possibly into the first region 1. The reason for this is that this will ensure that when the pipette is docked into the third region 3, the end of the pipette touches the filler fluid before entering the third region 3. This prevents any undesired air bubbles being forced into the device upon subsequent fluid loading.

In principle the third region 3 could extend all the way down to the end of the port. However, if the housing is to be made by injection moulding, the minimum diameter of any aperture is around 1mm. Since the ends of most commercial pipettes have a lower diameter less than this, it is necessary for a fourth region 4 to exist, and the draft (taper) of the fourth region 4 must be in the opposite direction to the draft (taper) of the third region 3. Therefore the parting line of the injection moulding tool must be between the third region 3 and the fourth region 4. Because of this it is preferable for the diameter of the port at the upper end of the fourth region 4 to be slightly larger than the diameter of the port at the lower end of the third region 3 (normally 1 mm), in order to minimize the risk associated with any misalignment of the tool parts coming together during production. The height of this parting line above the lower EWOD substrate 10 should be as low as possible without running the risk that a pipette could make contact with the lower EWOD substrate 10 upon fluid loading (which would prevent fluid issuing from the pipette and also risk damage to what could be the 'active' EWOD substrate.

The fourth region 4 may represent a "dead volume", in that some working fluid dispensed from the applicator will remain in the fourth region 4 of the well and will not be introduced in the fluid chamber. It may therefore be desirable to minimise the volume of the fourth region, subject to making the diameter of the port at the upper end of the fourth region 4 slightly larger than the diameter of the port at the lower end of the third region 3 and to making the height of the fourth region sufficient to eliminate (or reduce) the risk that the applicator could make contact with the lower EWOD substrate 10 insertion into the well.

The cross-section of the third region 3 is complementary to the external cross-section of the dispensing end 64 of the pipette (or other fluid applicator), to provide a seal that extends around the entire circumference of the pipette. This means that in general the third region will have a circular cross-section, as most pipettes (and other fluid applicators) have a circular external cross-section. The cross-section of the other regions of the fluid well may be freely chosen, and may be non-circular if desired. Moreover, while FIG. 5(*a*) shows all regions of the fluid well as being generally co-axial with one another this is not necessary—for example, if it were desired to increase the volume of the reservoir region (the first region 1) the first region could be extended to the left (where "left" relates to a housing oriented as shown in the figure) while leaving the other regions unchanged.

As noted FIG. 5(*a*) shows a housing suitable for use with a 'side-loading' microfluidic device in which apertures 66 for fluid loading are provided at the side edge of the upper substrate 16. The embodiment is however also generally applicable to a 'top-loading' microfluidic device in which apertures for fluid loading are provided in the upper substrate, with appropriate modifications to the housing and the microfluidic device.

It will be understood that FIG. 5(*a*) shows one embodiment of the fluid well, but that variations may be made. As one example, the second region 2 could in principle be omitted and the floor of the first region 1 made flat. However it has been found that this tends to hold back the filler fluid when the filler fluid is first introduced into the housing, as the flat section forms a barrier over which the filler fluid struggles to flow, and that providing the second region 2 with a tapering floor enhances the upwards flow of filler fluid into region 1. Likewise, the second region 2 helps the wells to ensure that all of the filler fluid loaded into the fluid well is available to drain into the channel of the microfluidic device, should filler fluid start to evaporate from region 1.

In the embodiment of FIG. 4, when the microfluidic device is positioned in the housing, the housing extends around the entire periphery of the upper substrate. In principle, however, the housing in general, and the fluid input ports in particular, need not extend around the entire periphery.

In the embodiment of FIG. 4 the housing contains multiple fluid wells. A microfluidic device typically contains multiple apertures for loading fluid into the device, and when the microfluidic device is positioned in the housing some or all of the fluid wells will be adjacent to respective fluid loading apertures of the device. In general there may be one or more wells intended for loading filler fluid and one or more wells intended for loading working fluid. Preferably, each well intended for loading working fluid has a cross-section as shown in FIG. 5(*a*); a well intended for loading filler fluid may have a cross-section generally as shown in FIG. 5(*a*), or may have another cross-section.

In embodiments of the device as described with respect to FIGS. 4 and 5 the internal diameter of region 3 at the interface with region 4 is at least about 0.1 mm, at least about 0.25 mm, at least about 0.5 mm, at least about 0.75 mm, at least about 1 mm, at least about 1.25 mm, at least about 1.5 mm, at least about 2 mm, at least about 3 mm, at least about 5 mm. The internal diameter of region 3 at the interface with region 2 is at least about 0.25 mm, at least about 0.5 mm, at least about 0.75 mm, at least about 1 mm, at least about 1.25 mm, at least about 1.5 mm, at least about 2 mm, at least about 3 mm, at least about 5 mm. The taper angle of region 3 is at least about 0 degrees, at least about 0.25 degrees, at least about 0.5 degrees, at least about 0.75 degrees, at least about 1 degree, at least about 1.25 degrees, at least about 1.5 degrees, at least about 1.75 degrees, at least about 2 degrees, at least about 5 degrees, at least about 10 degrees, at least about 15 degrees, at least about 25 degrees, at least about 45 degrees. The length of region 3 is at least about 0.1 mm, at least about 0.25 mm, at least about 0.5 mm, at least about 0.75 mm, at least about 1 mm, at least about 1.25 mm, at least about 1.5 mm, at least about 2 mm, at least about 3 mm, at least about 5 mm, at least about 10 mm. In an exemplary embodiment the internal diameter of region 3 at the interface with region 4 is 0.99 mm, the internal diameter of region 3 at the interface with region 2 is 1.12 mm, the taper angle of the internal wall of region 3 is 5.1 degrees and the length of region 3 is 1.48 mm.

Circular Pipette Ports—Inside Edge

As noted above, in the embodiment of FIG. 5(*a*) the internal cross-section of the third region 3 of a fluid well is complementary to the external cross-section of the end 64 of the pipette, to provide a seal that extends around the entire circumference of the pipette. This means that in general the third region of a fluid well will have a circular cross-section, since most pipettes have a circular external cross-section. It has been found that it can be preferable for the internal cross-sections of regions 1 and 2 of a fluid well also to be circular, in order to minimise the wicking of filler fluid up the sides of the well. Avoiding, or minimising, the wicking effect is desirable for two reasons. One reason is that it may be necessary to seal the top of the cartridge (in order to prevent oil evaporation) and this is difficult or even impossible if the top of the cartridge is wet from wicked filler fluid. The second reason is that if filler fluid should wick onto the top of the cartridge (and the cartridge is not sealed) then the rate of evaporation of filler fluid will increase, since filler fluid that has wicked onto the top of the cartridge forms a thin layer that is spread out over a larger surface area. (Such evaporation of filler fluid that has wicked onto the top of cartridge may have the further undesired effect of promoting further extraction of filler fluid.)

For the same reason (minimising the surface area of the filler fluid in order to prevent oil evaporation), it is also beneficial to have the narrowest possible diameter for region 1 and region 2 of a fluid well, which is where the filler fluid surface is designed to be.

Circular Pipette Ports—Outside Edge

Figure 8:
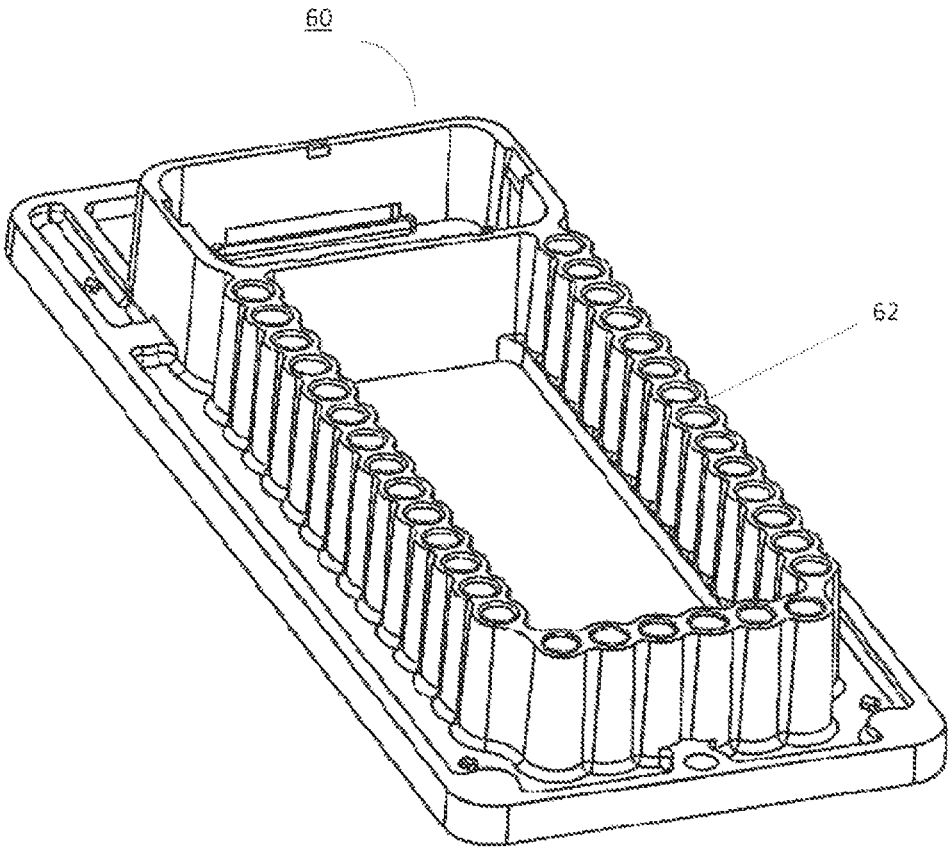
FIG. 8 is a schematic perspective view of a housing for a microfluidic device according to another embodiment of the invention.

From a manufacturability perspective, it may be beneficial to minimise the volume/thickness of the walls of the housing. Where a housing is produced by an injection moulding process, minimising the volume/thickness of the walls reduces or prevents the possibility that the internal dimensions of the well become distorted during drying of the polymer following injection moulding. In a case where the wells have a circular internal cross-section, the wall thickness is minimised by making the wells generally circular outside, as shown in FIG. 8 which is a perspective view of a housing 60 for a microfluidic device according to another embodiment Loading/Extraction From an efficiency of usage perspective, it is beneficial to design the plastic housing so that the end face of the pipette (or other fluid applicator) inserted into a fluid well is as close to the lower substrate 10 (usually the TFT substrate) as possible, without actually touching it. The height of region 3 of the well above the TFT substrate should therefore be positioned so that the end face of the pipette is almost in contact with, but not touching, the TFT substrate when the pipette is inserted into the well with the maximum expected insertion force.

Figure 9A:
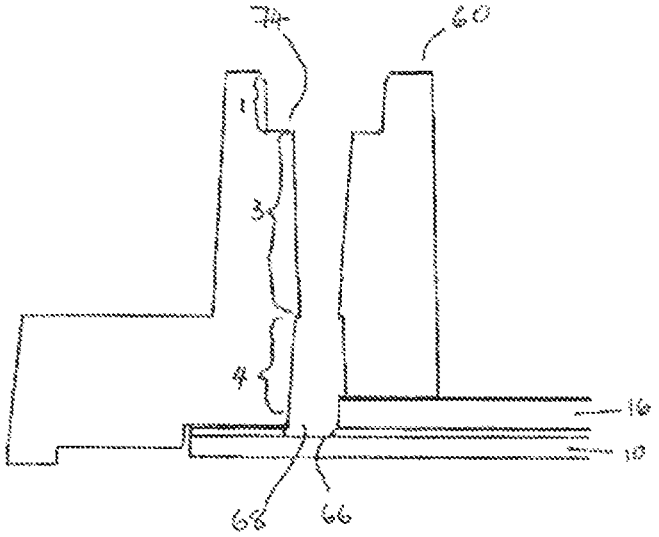
FIGS. 9(*a*) and 9(*b*) are schematic sectional views of a housing for a microfluidic device according to another embodiment of the invention.
Figure 9B:
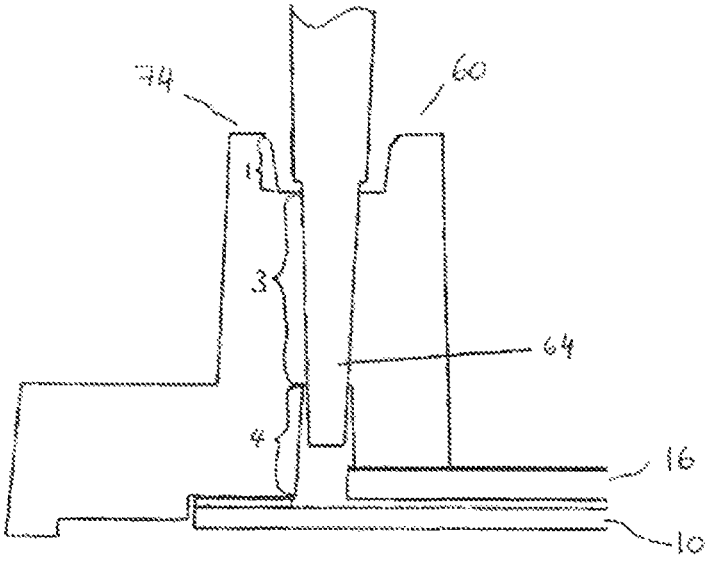

The maximum expected insertion force may however be difficult to define. In a further embodiment, therefore, a fail-safe mechanism is provided by configuring the interior of the fluid well to engage with a fluid applicator inserted into the fluid well, to thereby prevent further movement of the fluid applicator into the fluid well and so prevent a user from inserting the pipette too far into the well. This may be done, for example by creating an extra ridge within the well of the housing, such that the ridge engages with the exterior of a pipette inserted into the well so as to prevents a user from inserting the pipette too far into the well. An example of such a ridge is illustrated at 74 in FIG. 9(*a*), which is a sectional view through a housing according to this embodiment. FIG. 9(*b*) shows a fluid applicator, in this example a pipette, inserted into the housing shown in FIG. 9(*a*). As shown in FIG. 9(*b*), the ridge 74 engages with a "step" in the external cross-section of the end of the pipette and defines a maximum distance to which the pipette may be inserted into the well. By suitably positioning the ridge 74, the presence of the ridge will prevent the pipette being inserted to such a depth that the pipette would touch the TFT substrate. A further refinement to the housing depicted in FIG. 9(*a*), as compared with that of FIG. 5(*a*), is in the omission of region 2. As depicted in FIG. 9(*a*), region 3, which is contacted by the outer surface of the fluid applicator has a greater length. As a consequence of the increased surface contact between the fluid applicator and the wall of the housing, it is less likely that a "heavy handed" user could insert a fluid applicator too far into the housing; thereby mitigating contact between the end of the fluid applicator and lower substrate 10.

In a further embodiment (not illustrated), the ridge 74 may be provided in a housing in which region 2 is present in the fluid well. This may be done, for example, by providing a ridge in region 1 of a well as shown in FIG. 5(*a*).

Some example of methods of usage of these pipette ports will now be described.

Method 1—Rapid Fluid Input

In the first method of usage, the pipette (or other fluid applicator) is loaded with a working fluid as usual, and is then inserted into the relevant fluid well. The housing and microfluidic device have already been loaded with filler fluid, such that the level of filler fluid is in the first region 1 or the second region 2 of the fluid well(s) and the fluid chamber of the device is completely filled with filler fluid. The pipette is inserted into the fluid well such that the outer surface of the end of the pipette sealingly engages against the sealing region (the third region 3) of the fluid well as described above. Fluid is then dispensed from the pipette into the fourth region 4 of the fluid well and so into the fluid chamber of the device. As the aperture in the pipette (or other fluid applicator) from which fluid is dispensed is immersed in filler fluid (it is below the level of filler fluid in the fluid well) there is no risk of air being inadvertently introduced into the fluid chamber of the device.

It can therefore be seen that the fluid well of this aspect provides the following advantages:

- It can be flooded with oil (or other filler fluid) on initial loading of filler fluid;
- It forms a reserve of filler fluid, and so avoids the need for a dedicated reserve which takes up valuable space around the perimeter of the device
- It can provide successful loading of working fluid, even when the microfluidic device is filled with filler fluid.

In the case of a manual pipette, one method for dispensing working fluid after insertion of the pipette as described above is for the user to then push the pipette plunger slowly down from its "fully out" position, firstly to the usual 'stop' so that the working fluid issues from the end of the pipette into the fourth region 4 of the pipette port. Many available pipettes allow a predetermined volume of working fluid to be dispensed pushing the pipette plunger from its "fully out" position down to the 'stop', The user then continues to push the pipette plunger slowly down beyond the 'stop', so that a fluid different to the working fluid (for example an air bubble) issues from the end of the pipette, and pushes the working fluid expelled from the pipette away from the end of the pipette, and, via the aperture 66, into the main channel of the EWOD device between the upper and lower substrates 10, 16. If the user makes one continuous push of the plunger of the pipette down to and past the 'stop', the working fluid is only momentarily present in section 4 before being forced into the device as the user pushes the pipette plunger beyond the 'stop' in the pipette. Once the working fluid is safely loaded into the device, the pipette can be retracted from the device with the plunger held in the 'down' position (that is, in the position past the 'stop' to which the plunger was pushed to expel the second fluid). Provided that the air bubble has remained connected to the pipette, when the pipette is retracted from the device little or no air remains in the device (although it may result in an air bubble residing within region 4 of the fluid well after removal of the pipette).

In further embodiments of this method the electrodes of the device may be controlled in order to further ensure that working fluid loaded into the device is not inadvertently extracted when the pipette (or other fluid applicator) is retracted from the well. This is described further in section 2 below.

Method 2—Fluid Input Suitable for Subsequent Heating

The method described above is suitable for room temperature operation of the device, but may result in an air bubble residing within region 4 of the fluid well after removal of the pipette (or other fluid applicator). This may be undesirable as, upon heating the device, it is possible that the air bubble could move into the EWOD channel, especially if this area of the device is hotter than the perimeter.

In an alternative method, the user proceeds in exactly the same fashion as in method 1, except that once it is safe to take the pipette out from the well, the user instead first allows the pipette plunger slowly back up into the 'fully out' position. Provided that the air bubble has remained connected to the end of the pipette, both the air bubble and a volume of filler fluid (equal to the volume of working fluid just loaded) are retracted into the pipette. Then the pipette can safely be retracted from the well without any risk of leaving an air bubble inside the device. This method has the added feature of maintaining the original level of filler fluid within the device (in method 1, the level will rise for each working fluid loaded).

In further embodiments of this method the array elements of the device may be controlled in order to further ensure that working fluid loaded into the device is not inadvertently extracted when the pipette is retracted. This is described further in section 2 below.

Method 3—Fluid Extraction

The pipette ports described in this application are bi-directional: they can be used to extract fluid as well as inject it. In order to extract working fluid from the device, preferably the working fluid should be positioned as close as possible to the relevant pipette port, and a 'shrinking hold' electrode pattern applied, for example as described in EP 3311919.

Once this adaptive holding pattern has been applied, the user should take a pipette, push down the plunger to the desired extract volume, insert the pipette into the relevant pipette port and slowly allow the plunger to come back out. Provided that the aspiration volume of the pipette is high enough, then the desired droplet will be extracted successfully. (The "working fluid" that is removed is not necessarily the same as the "working fluid" loaded into the fluid chamber, for example if an assay is being performed. In this case, to avoid contamination of the fluid that is being extracted, the pipette used for this fluid removal is preferably a different pipette, or has a new disposable pipette tip attached, than was used for fluid loading into the device.)

While methods 1, 2 and 3 have been described with reference to direct manual control of the pipette by the user, these methods may alternatively be implemented by remote control, automatic control or robotic control.

2. Array Element Control to Assist Loading of Working Fluid

The basic concept of this aspect of the invention is to control array elements of an EWOD microfluidic device to guide fluid loaded into the fluid channel of the EWOD device channel into a 'safe' position, and give feedback to the user that this has been done. As a result, when the pipette is retracted from the device, all of the loaded working fluid remains on the device (although filler fluid/oil may be lost).

The array element control of this aspect may be applied in combination with the fluid loading method described in part 1 above, but it is not limited to this and may be applied with any fluid loading method. It is of most use in the case where the device cell gap is below a certain critical value (between 250 um and 500 um), and the user is trying to introduce working fluid when the device is already full of filler fluid.

Method A

Figure 6:
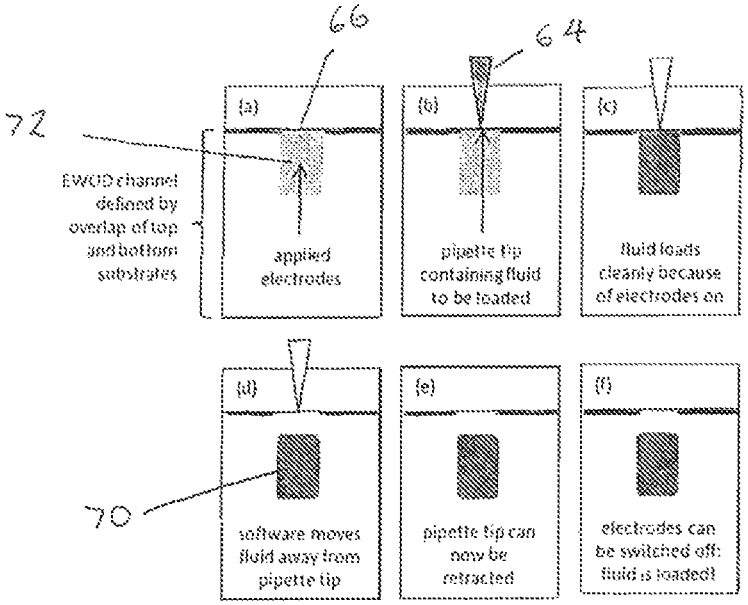
FIG. 6 is a series of schematic views from above of a microfluidic device illustrating a method of loading fluid into the device including steps (a) through (f) according to an embodiment of the invention.

The simplest example of array element control to assist loading of working fluid is illustrated in FIG. 6, which shows a top-down view of an EWOD device which has a lower substrate which is larger in extent than the upper substrate, so providing a loading aperture along one of the sides of the top substrate. It is desired to load a working fluid into a first region (or target region) of the microfluidic device, for example the region 70 shown in FIG. 6(*d*).

In this aspect, the microfluidic device has a plurality of independently addressable array elements (for example an AM-EWOD microfluidic device), with each array element corresponding to a respective region of the fluid chamber. As described with reference to FIG. 1, an array element of the microfluidic device may be defined by a corresponding array element electrode 12A, 12B. The array elements are controlled by an EWOD control means that is configured to determine that a working fluid has been introduced into the region 70 of the fluid chamber, and provide an output signal to indicate that the working fluid is present in the target region 70. The target region 70 corresponds to a first group of one or more of the array elements. In the case of manual loading of fluid the output signal may be an audible or visual signal provided to alert the user that the working fluid is present in the region 70, and in the case of automatic or robotic loading of fluid the output signal may be provided to the system controlling the automatic or robotic loading of fluid.

In the method of FIG. 6, initially (FIG. 6(*a*)) a second group of one or more of the array elements, corresponding to a second region 72 of the microfluidic device, are actuated by the EWOD control means. The second region 72 is different from the first (target) region 70, although there may be some overlap between the first region and the second region; the first group of one or more of the array elements is therefore different from the second group of one or more of the array elements, although it is not excluded that at least one array element may be common to both the first and second groups.

In this embodiment it is assumed that controllable array elements are provided up to the fluid loading aperture 66. The second region 72 therefore extends to, or very close to, the aperture 66.

At FIG. 6(*b*) the end of a pipette, or other fluid applicator, is positioned adjacent to the fluid loading aperture 66.

Fluid is then dispensed from the pipette or other fluid applicator. This may for example be performed as described above with reference to "method 1" or "method 2" for fluid loading, or it may be done in any other suitable way. As shown in FIG. 6(*c*), the dispensed fluid loads cleanly into the second region 72 of the microfluidic device since the array element(s) of the second region 72 are actuated.

The EWOD control means then ceases actuation of the second group of array elements defining the second region 72, and actuates the first group of array elements defining the first (target) region 70 of the microfluidic device. As a result, the fluid that was loaded in to the device in step (c) is moved into the first region 70, as shown in FIG. 6(*d*), by electrowetting.

Once the fluid is moved into the first region 70, the pipette can then be retracted without any risk of accidentally withdrawing the dispensed fluid from the microfluidic device. FIG. 6(*e*) shows the device after removal of the pipette.

The EWOD control means then ceases actuation of the first group of array elements defining the first (target) region 70 of the microfluidic device, and the fluid remains in the first region as shown in FIG. 6(*f*). The array elements may then be controlled to perform any desired droplet operation on the fluid introduced into the first region.

As noted, at the end of step (d) feedback is preferably provided to the user to let them know that the fluid has been moved into the target region 70 and that it is safe to retract the pipette. This feedback could for example be in the form of an audible signal, or a visual cue from the software graphical user interface (GUI) (or both). Note that as in the two possible fluid loading methods disclosed in section 1 above, there are two options when retracting the pipette: either it can be retracted with the plunger still down (in which case the level of filler fluid within the device grows as a result of the loading of working fluid), or the plunger can be slowly let back up to its natural resting position, in order to draw out a volume of filler fluid that matches that of the working fluid just loaded (in which case the level of filler fluid remains constant). These two methods are applicable to all embodiments in this section.

There are many variants on this simplest case above. Firstly, there are variants in the array element actuation patterns applied, and these will be described below. Then there is the applicability of each of these different actuation patterns to different device structures, which include:

a) Simple 2-substrate device as above, with no housing, where controllable EWOD array elements are provided up to the injection point (as in FIG. 6);
b) As above, but where there is a physical gap between the pipette injection point and the nearest controllable EWOD array element (as described with reference to FIG. 7);
c) A device having a housing as described in section 1 above, where the fluid is injected forcibly by pipettes which are fluidically sealed to the housing.

Figure 7:
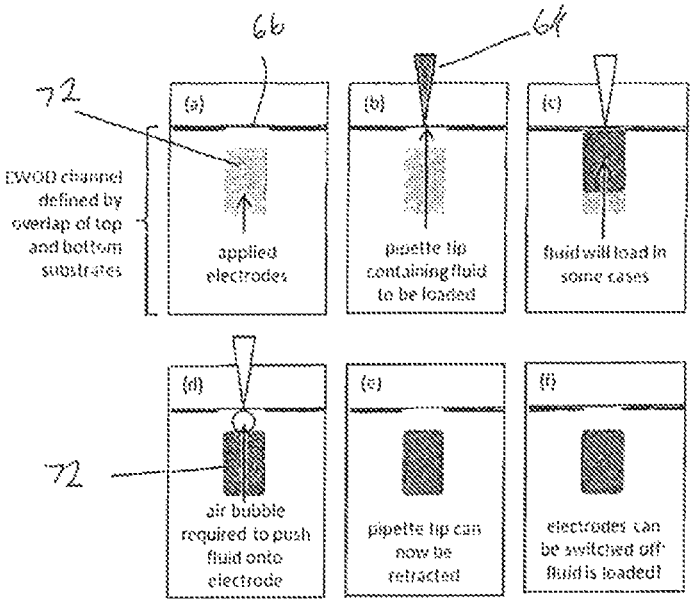
FIG. 7 is a series of schematic views from above of a microfluidic device illustrating a method of loading fluid into the device including steps (a) through (f) according to another embodiment of the invention.

The applicability of each of the actuation patterns to these 3 different device types will sometimes depend on the device cell gap and will (in many cases) be dependent on using the method of 'pushing through the stop' of the pipette in order to use a temporary air bubble to push the fluid away from the end of the pipette and onto the one or more of the element electrodes of the EWOD device), as shown in FIG. 7. Some steps of the method of FIG. 7 are similar to the corresponding step of the method of FIG. 6, and only the difference will be described.

In the method of FIG. 7 it is assumed that controllable array elements of the EWOD device are not provided up to the fluid loading aperture 66. There is therefore a gap between the second region 72 and the aperture 66. As a result, when fluid is dispensed from the pipette, the fluid may not load fully into the second region 72, as indicated in FIG. 7(*c*).

As a result, the pipette (or other fluid applicator) is further actuated to dispense a bubble of air (or other fluid different to the working fluid being dispensed), so as to load the working fluid fully into the second region 72 as shown in FIG. 7(*d*). Provided that the air bubble remains connected to the end of the pipette, once the working fluid is loaded into the second region 72 the pipette may be actuated to withdraw the air bubble from the fluid chamber of the device and back into the pipette, with the working fluid being held in the device owing to the actuation of the array elements. Once this is done, the pipette can be retracted as shown in FIG. 7(*e*). The EWOD control means then ceases actuation of the second group of array elements defining the second region 72 (FIG. 7(*f*)), and actuates the first group of array elements defining the first (target) region 70 of the microfluidic device, to move the fluid to the first region 70 (not shown).

In a modification of this method, the target region may be sufficiently close to the aperture 66 so that, once working fluid has loaded into the microfluidic device as shown in FIG. 7(*d*), the working fluid may be moved directly to the target region by actuating the group of array elements defining the target region 70 of the microfluidic device. This corresponds to FIG. 7(*d*), except that working fluid is loaded into the target region 70. The pipette can then be retracted, and the EWOD control means then ceases actuation of the array elements defining the target region.

In the method of FIG. 7 feedback is again preferably provided to the user at the end of step (d), to let them know that the fluid has been moved into the target region 70 and that it is safe to retract the pipette.

This aspect is not limited to the specific actuation pattern of FIG. 6 or FIG. 7, and many variants are possible.

Method B

In this method, no array elements are actuated initially, but once working fluid is sensed as being introduced into the fluid chamber of the device, for example in any of the ways described with reference to method A above, array elements are actuated. This corresponds to FIG. 6 or FIG. 7, but with the second group of array elements not being actuated until working fluid had been detected as having entered the fluid chamber.

In a related variant, no array elements are actuated initially and array elements are again actuated once working fluid is sensed as being introduced into the fluid chamber of the device. In this variant, however, the group of array elements that are actuated is time-dependent, so that the second region 72 changes with time to match the current volume of fluid introduced into the fluid chamber and to shape the fluid into a prescribed shape (e.g. circular or rectangular). When the fluid stops growing in size, the EWOD control means then ceases actuation of the second group of array elements defining the second region 72, and actuates the first group of array elements defining the first (target) region 70 of the microfluidic device in order to move the fluid away from the aperture 66 to the first (target) region 70, as in the example above, before giving the user the cue to retract the pipette. This variant may be particularly useful if the volume to be loaded is unknown, or particularly small.

The group of array elements that are actuated to define the time-dependent second region 72 may be based on the sensed volume of working fluid that has entered the fluid chamber, as described further below, to provide adaptive control of the array element actuation. Alternatively the group of array elements that are actuated to define the time-dependent second region 72 may be actuated according to a pre-set pattern that is expected to correspond to the rate at which fluid enters the fluid chamber.

Method C

In this method, there is no change in the array element actuation pattern at all. A fixed group of one or more array elements is actuated to define an actuated region of the device at a 'safe' distance from the edge of the EWOD fluid channel ('safe' meaning that if the fluid reaches the actuated region, then it is possible to retract the pipette (or other fluid applicator) without taking any of the working fluid out of the EWOD channel). When it is determined that the fluid has reached the actuated region of the device the control means, for example the EWOD control unit mentioned above, gives or causes to be given, an audible or visual cue to the user to retract the pipette. In this case it will always be necessary to use the 'push through the stop' method for the pipette in order to provide the air bubble to push the dispensed fluid from the aperture 66 to the actuated array elements.

This second variant corresponds to the method of FIG. 7, except that a fixed group of one or more array elements is continually actuated until after the pipette has been retracted, so that the region 72 is the same as the region 70

Method D

This method is a combination of the second and third methods, in which no array elements are actuated initially, but a time dependent group of array elements are actuated once the fluid has reached the "safe zone" of the EWOD channel (eg, has reached the target region 70). This variant can be used in cases where there simply are no electrodes within the 'unsafe' zone of the EWOD channel, and may be advantageous in other cases where there are electrodes in that zone. The group of array elements that are actuated may be based on the sensed volume of working fluid to provide adaptive control of the array element actuation, or may be actuated according to a pre-set pattern.

The above description of the methods 1 to 4 refers to the working fluid being 'safe' or to 'safe' and 'unsafe' zones within the fluid channel of the EWOD device. As used herein, an "unsafe zone" refers to a zone around the injection point (eg the fluid aperture 66) in which, should a droplet of working fluid happen to reside there at the moment of pipette extraction, it may (depending on the force of the user during this extraction process) be at risk from being extracted from the fluid channel, even if EWOD array elements are actuated to hold it as the electrowetting force produced by the electrodes may be relatively weak compared to the force exerted by the pipette. The extent of the "unsafe" zone will depend on many things, such as EWOD voltage, the thickness of the EWOD dielectric, the pipette extraction speed, working fluid viscosity, cell gap, and proximity of the end of the pipette to the droplet at the moment of extraction, to name but a few. It could be up to several mm in extent. Conversely, a "safe zone" refers to a zone that is sufficiently far from the fluid aperture 66 that, should a droplet of working fluid happen to reside there at the moment of pipette extraction, the droplet is at minimal or no risk of being extracted from the fluid channel.

The size and/or location of the "unsafe" zone may be determined by the device manufacturer/supplier, based on characteristics of the microfluidic device such as the cell gap and the size of a fluid aperture 66. Alternatively, the size and/or location of the "unsafe" zone may be determined for a particular fluid loading process, as the size of the unsafe zone may also depend on the characteristics of the particular fluid being loaded as well as on characteristics of the device. Where the size and/or location of the "unsafe" zone are determined for a particular fluid loading process, this may be done manually by a user, or may be done by a control unit (such as the EWOD control unit that controls actuation of the array elements).

Defining the size and/or location of the "unsafe" zone could be as simple as defining a conservative unsafe zone around each injection point. Once that unsafe zone has been judged to have been successfully traversed by the loaded fluid, and the unsafe zone vacated (perhaps by a certain time), the signal that the pipette may be retracted can be given.

One factor that may influence which array element actuation pattern to use is the structure of the microfluidic device, as set out in the table below.

Note that, in all cases, all the methods A to D should be possible above a critical cell gap for the microfluidic device. This table concentrates on a case of interest, which is that of devices with lower cell gaps where the fluid loading is more challenging. In the cases where there is a physical gap between the end of the pipette (or other fluid applicator) and the applied electrodes, an air bubble will be required to separate the fluid from the end of pipette.

| Method | No housing, aperture adjacent to array elements (a)* | No housing, aperture separated from array elements (b)* | Housing enabling forced fluid loading (c) |
|---|---|---|---|
| A | yes | no | yes (bubble) |
| B | no | no | yes (bubble) |
| C | no | no | yes (bubble) |
| D | no | no | yes (bubble) |

In this table, "yes (bubble)" indicates that the method may be applied but that, for devices with low cell gaps, it may be necessary to dispense an air bubble to force the dispensed fluid into the fluid chamber of the device.
*Note that the success of the fluid loading into the devices without a plastic housing ((a) & (b)) will be highly dependent on the cell gap of the device, and there will be a critical cell gap below which the fluid loading without a housing that can seal around the fluid applicator will not be possible. It is expected that this critical cell gap will be higher for the cases where the electrodes are not adjacent to the end of the pipette (b). Exact cell gaps will be dependent on the specific filler fluid and working fluid(s).

After the pipette has been retracted, the droplet can subsequently re-enter the 'unsafe' zone of the device, as it is no longer unsafe in the absence of the pipette. It may be advantageous to allow this, because it allows for a better use of the EWOD channel area for subsequent droplet operations, and hence allowing the droplet to return to the 'unsafe' zone once the pipette has been retracted could be applied with any one of the array element actuation patterns above. For example, in the case of manual operation, once the pipette has been retracted the user may give some signal (e.g. a key stroke or mouse click) to indicate this, and the EWOD control unit may then be enabled to actuate the array elements to draw the droplet into the previously "unsafe" zone. Similarly, in a fully robotic implementation the control unit that controls the physical location of the pipette, or a sensor monitoring the pipette position, may provide a signal indicating the pipette has been retracted.

This invention as described so far has been concerned with the safe loading of the complete volume of working fluid that resides in the pipette, with respect to eliminating, or at least significantly reducing, the risk of working fluid being mistakenly withdrawn from the working area of the microfluidic device when the pipette is retracted.

Although many measures can be taken to prevent working fluid being mistakenly withdrawn (as described above), it should easily be possible to detect whether this has happened by the use of the sensor array which is integrated into the EWOD electrode array. If (for example), the assay protocol requires 5 ul of working fluid to be loaded, but the sensor array records that only 3 ul has been loaded through some kind of user mishap (such as an incorrect volume of working fluid being loaded, or the correct volume of working fluid being loaded initially but some of the working fluid being inadvertently extracted when the fluid applicator is withdrawn), then a warning can be given to the user to add more fluid, try again or extract the 3 ul and repeat.

In a similar vein, it may be that actually the correct volume has successfully been loaded, but the position of the fluid within the microfluidic device is incorrect (this will depend on the type of software function chosen), or it has merged with a nearby droplet which has perhaps been loaded from a nearby (or the same) fluid loading well. Again, the sensor array built into the device can be utilised to alert the user that such an event has occurred, and prompt them to take appropriate action (e.g. remove the cartridge from the experiment, and start again).

Another possibility is that the droplet of working fluid finishes in the correct position, but in the process of getting there, it may have temporarily resided on an unplanned area of the device. This event is quite likely if the user is rather forceful in pushing the pipette plunger through the stop of the pipette and injects an air bubble that is rather larger than the minimum necessary to nudge the dispensed working fluid onto the desired electrodes. Even though the malpositioning is only transient, this could present a contamination issue in the case of an assay in which areas of the EWOD array are meant to remain pristine and un-used before the introduction of a particular type of working fluid, e.g. in the case where multiple samples are to be analysed independently within the same device. Yet again, the real-time sensor information can be used to warn the user of any such risk, and thus allow the user to decide whether or not to proceed or start again from fresh.

All of the embodiments described herein could alternatively be implemented with the use of an electronic pipette that was controlled by, or in conjunction with, the EWOD control unit that controls actuation of the array elements of the EWOD microfluidic device. Such a pipette could be automated to provide exactly the right loading speeds for the phase of loading working fluid, and the extra 'push through the stop' phase could be controlled very precisely to avoid potential user errors.

In the case of manual fluid loading the warning or alert (or other output) is provided to a user and may for example be an audible and/or visual output, whereas in the case of automated or robotic fluid loading the output is provided to a control unit that is controlling the automated or robotic fluid loading, for example the EWOD control unit, and may for example be an electrical or optical signal.

For example, it would be advantageous to have the speed of formation of the air bubble controlled in order to prevent users from pushing through the stop too forcibly so that the air bubble detached from the pipette. If the air bubble should become detached from the pipette, this would mean that the air bubble was then unrecoverable before pipette retraction. An automated pipette would prevent such a mishap.

It would also be advantageous to control the amount of air injection so that the air bubble is made just large enough that the fluid contacts the electrodes. The sensor feedback from the EWOD array elements would provide information (perhaps wirelessly) to the pipette in order to control this phase of the fluid injection. Once the fluid has been put onto the electrodes as in FIG. 7(*d*), it may be safe to start retracting the air bubble and excess filler fluid during the time taken for the droplet to reach the safe zone. This will speed up the process of fluid loading.

In addition, such an intelligent pipette could also be advantageous in that it could be programmed to follow the complete loading sequence of a particular assay or protocol to be carried out on the device. It could automatically aspirate the correct volumes for the various ports. All the user would need to do is change the pipette (or change the pipette tip), immerse the end of the pipette into the correct reagent tube, and dock with the correct port.

There could also be safety features built in that detect whether the user has selected the correct port. If they have not, the pipette could automatically retract the fluid droplet back into the pipette, and the software would remind the user which port they should have loaded into and to try again immediately.

The pipette could also assist with fluid extraction: the speed of aspiration could be adaptive to the shrinking volume of the droplet sensed on the device to minimise user errors.

Some of the above embodiments involve dispensing an air bubble from the pipette to force the dispensed fluid into the fluid channel of the microfluidic device. It may be that some users are uncomfortable with the concept of injecting air bubbles (albeit temporarily) into their devices. If that were to be the case, an alternative is for the user to draw a volume of filler fluid into the pipette after the working fluid has been loaded into the pipette. That way, the fluid dispensed after dispensing the working fluid, and following the working fluid onto the device, is filler fluid instead of air. Dispensing oil (or other filler fluid) after the working fluid works in exactly the same fashion as dispensing an air bubble, but has the advantage of not alarming a user by the sight of an air bubble on the device.

With a manual pipette, dispensing oil (or other filler fluid) after the working fluid can be achieved but may be difficult to perform. However, an intelligent pipette (as outlined above) could perform a double fluid load easily if programmed correctly.

Some of the above embodiments involve sensing the presence and/or position of fluids within the EWOD microfluidic device, for example sensing that the fluid has reached the target region 70 in the method of FIG. 6. This may be done by controlling the EWOD array elements to operate in a sensing mode—a sensor may be configured as internal sensor circuitry incorporated as part of the drive circuitry in each array element. Such sensor circuitry may sense droplet properties by the detection of an electrical property at the array element, such as impedance or capacitance. For example, the array element circuit present in each array element may contain a droplet sensor circuit, which may be in electrical communication with the electrode of the array element. Typically, the read-out of the droplet sensor circuit may be controlled by one or more addressing lines that may be common to elements in the same row of the array, and may also have one or more outputs, e.g. OUT, which may be common to all elements in the same column of the array. The array element circuit may typically perform the functions of:

(i) Selectively actuating the element electrode by supplying a voltage to the array element electrode. Accordingly, any liquid droplet present at the array element 51 may be actuated or de-actuated by the electro-wetting effect.

(ii) Sensing the presence or absence of a liquid droplet at the location of the array element. The means of sensing may be capacitive, optical, thermal or some other means. Capacitive sensing may be employed conveniently and effectively using an impedance sensor circuit as part of the array element circuitry.

Exemplary configurations of array element circuits including impedance sensor circuitry are known in the art, and for example are described in detail in U.S. Pat. No. 8,653,832, and commonly assigned UK application GB1500261.1, both of which are incorporated here by reference. These patent documents include descriptions of how the droplet may be actuated (by means of electro-wetting) and how the droplet may be sensed by capacitive or impedance sensing means. Typically, capacitive and impedance sensing may be analogue and may be performed simultaneously, or near simultaneously, at every element in the array. By processing the returned information from such a sensor, the control system described above can determine in real-time, or almost real-time the position, size, centroid and perimeter of each liquid droplet present in the microfluidic device.

Alternatively, an external sensor module may be provided for sensing droplet properties. For example, optical sensors as are known in the art may be employed as external sensors for sensing droplet properties. Suitable optical sensors include camera devices, light sensors, charged coupled devices (CCDs) and image similar image sensors, and the like.

The invention claimed is:

1. An electrowetting on dielectric (EWOD) microfluidic device comprising:

an upper substrate and a lower substrate spaced apart from each other and defining a fluid chamber therebetween;

an aperture defined by at least one of the upper substrate and the lower substrate for introducing fluid into the fluid chamber;

a plurality of element electrodes, each of the plurality of element electrodes defining a respective element of the EWOD device; and a fluid input structure disposed over the upper substrate and having a fluid well for receiving fluid from a fluid applicator inserted into the fluid well, the fluid well communicating with a fluid exit provided in a base of the fluid input structure, the fluid exit being adjacent the aperture;

wherein the fluid well comprises first, second and third portions, the first portion of the well forming a reservoir for a filler fluid;

the second portion of the well being configured to sealingly engage against an outer surface of a fluid applicator when the fluid applicator is inserted into the fluid well;

the third portion of the well communicating with the fluid exit and having a diameter at an interface of the third portion and the second portion that is greater than a diameter of the second portion at the interface of the third portion and the second portion; and the interface of the third portion and the second portion is spaced apart from an interface of the third portion and an upper surface of the upper substrate.

2. The microfluidic device as claimed in claim 1, wherein the aperture is defined between the upper substrate and the lower substrate.

3. The microfluidic device as claimed in claim 1, wherein the aperture is defined in the upper substrate.

4. The microfluidic device as claimed in claim 1, wherein an axial length of the third region of the well is such that, when the fluid applicator is inserted into the fluid input structure so that the outer surface the fluid applicator sealingly engages against the second portion of the well, an end of the fluid applicator is spaced from the upper and lower substrates.

5. The microfluidic device as claimed in claim 1, wherein the fluid input structure extends around a periphery of the upper substrate.

6. The microfluidic device as claimed in claim 1, and comprising a plurality of apertures for introducing fluid into the fluid chamber; wherein the fluid input structure comprises a plurality of fluid wells, each of the plurality of fluid wells being associated with a respective aperture.

7. The microfluidic device as claimed in claim 1, wherein the fluid well is configured to engage with a fluid applicator inserted into the fluid well, to thereby prevent further movement of the fluid applicator into the fluid well.

8. The microfluidic device as claimed in claim 1, wherein the second portion tapers in a narrowing manner toward the third portion.

9. The microfluidic device as claimed in claim 8, wherein the third portion tapers in an opposite direction relative to the taper of the second portion.

10. The microfluidic device as claimed in claim 1, further comprising a transition portion that tapers in a narrowing manner from the first portion to the second portion.

11. A method of loading a fluid into the microfluidic device as defined in claim 1, the method comprising:

loading a filler fluid into the microfluidic device such that the filler fluid at least partially fills the first portion of the fluid well;

inserting a fluid applicator into the fluid well such that the outer surface of the fluid applicator sealingly engages against the second portion of the fluid well; and dispensing working fluid from the fluid applicator.

12. The method as claimed in claim 11, and further comprising, after dispensing the working fluid from the fluid applicator into the fluid well, dispensing a second fluid from the fluid applicator.

13. The method as claimed in claim 12, wherein the dispensed second fluid remains connected to the fluid applicator.

14. The method as claimed in claim 12, wherein the second fluid is air.

15. The method as claimed in claim 12, further comprising actuating at least one element electrode of the microfluidic device to hold the dispensed working fluid in the fluid chamber of the microfluidic device, and after actuating the at least one element electrode, extracting the second fluid from the fluid chamber.

16. The method as claimed in claim 15, wherein the fluid applicator is a pipette and dispensing fluid from the fluid applicator comprises pushing a plunger of the pipette to a first position to dispense working fluid and subsequently pushing the plunger beyond the first position to dispense the second fluid, and wherein extracting the second fluid from the fluid chamber comprises retracting the fluid applicator from the well with the plunger beyond the first position.

17. The method as claimed in claim 15, wherein the fluid applicator is a pipette and dispensing fluid from the fluid applicator comprises pushing a plunger of the pipette to a first position to dispense working fluid and subsequently pushing the plunger beyond the first position to dispense the second fluid, and wherein extracting the second fluid from the fluid chamber comprises returning the plunger, or allowing the plunger to return, to the first position before retracting the fluid applicator from the well.

18. The method as claimed in claim 11, further comprising actuating at least one element electrode of the microfluidic device to hold the dispensed working fluid in the fluid chamber of the microfluidic device.

19. The method as claimed in claim 18, further comprising after actuating the at least one element electrode, extracting the second fluid from the fluid chamber, and after actuating the at least one element electrode, extracting a volume of filler fluid from the fluid chamber.

20. The method as claimed in claim 19, wherein the volume of filler fluid extracted from the fluid chamber is equal to the volume of working fluid dispensed from the fluid applicator.

* * * * *